US011766584B2

(12) United States Patent
Chiavegato et al.

(10) Patent No.: US 11,766,584 B2
(45) Date of Patent: Sep. 26, 2023

(54) EXERCISE MACHINE

(71) Applicant: Akuis S.R.L., Tolmezzo (IT)

(72) Inventors: Mattiarmando Chiavegato, Tolmezzo (IT); Alessandro Englaro, Padua (IT)

(73) Assignee: AKUIS S.R.L., Tolmezzo (IT)

( * ) Notice: Subject to any disclaimer, the term of this patent is extended or adjusted under 35 U.S.C. 154(b) by 252 days.

(21) Appl. No.: 17/424,156

(22) PCT Filed: Jan. 22, 2020

(86) PCT No.: PCT/IT2020/050006

§ 371 (c)(1),
(2) Date: Jul. 19, 2021

(87) PCT Pub. No.: WO2020/152728

PCT Pub. Date: Jul. 30, 2020

(65) Prior Publication Data

US 2022/0105378 A1 Apr. 7, 2022

(30) Foreign Application Priority Data

Jan. 22, 2019 (IT) ..... 102019000000933

(51) Int. Cl.
*A63B 21/005* (2006.01)
*A63B 21/00* (2006.01)

(52) U.S. Cl.
CPC ..... *A63B 21/0058* (2013.01); *A63B 21/156* (2013.01); *A63B 21/4035* (2015.10); *A63B 21/4043* (2015.10); *A63B 2208/0204* (2013.01); *A63B 2220/16* (2013.01); *A63B 2220/52* (2013.01); *A63B 2220/803* (2013.01)

(58) Field of Classification Search
CPC ..... A63B 21/0058; A63B 21/4035; A63B 21/4043; A63B 21/156; A63B 2208/0204; A63B 2220/16; A63B 2220/52; A63B 2220/803
See application file for complete search history.

(56) References Cited

U.S. PATENT DOCUMENTS

2014/0121071 A1* 5/2014 Strom ..... A63B 21/156 482/99

FOREIGN PATENT DOCUMENTS

| | | | | |
|---|---|---|---|---|
| EP | 3202465 A1 | 8/2017 | | |
| EP | 3203465 A1 * | 8/2017 | ..... | G06F 15/16 |
| GB | 2541725 A | 3/2017 | | |
| WO | 2017133823 A1 | 8/2017 | | |

OTHER PUBLICATIONS

Int'l Search Report and Written Opinion dated Apr. 30, 2020 in Int'l Application No. PCT/IT2020/050006.

* cited by examiner

*Primary Examiner* — Sundhara M Ganesan
*Assistant Examiner* — Jacqueline N L Loberiza
(74) *Attorney, Agent, or Firm* — Panitch Schwarze Belisario & Nadel LLP

(57) ABSTRACT

A machine for gymnastic exercises includes a gripping element which can be gripped by a user, and a first motor and a second motor able to be commanded independently from each other and each configured to generate respective loads suitable to define a resistant force perceived on the gripping element during a traction exerted on the latter by a user. The machine also includes a sliding guide and a slider installed slidingly on the sliding guide.

10 Claims, 3 Drawing Sheets

EXERCISE MACHINE

CROSS-REFERENCE TO RELATED APPLICATIONS

This application is a Section 371 of International Application No. PCT/IT2020/050006, filed Jan. 22, 2020, which was published in the English language on Jul. 30, 2020, under International Publication No. WO 2020/152728 A1, which claims priority under 35 U.S.C. § 119(b) to Italian Application No. 102019000000933, filed Jan. 22, 2019, the disclosures of each of which are incorporated herein by reference in their entireties.

FIELD OF THE INVENTION

The present invention concerns an exercise machine suitable to develop motor skills, muscular strength, and also suitable to be used for medical or rehabilitation purposes. In particular, the present invention concerns an exercise machine in which the user acts on a gripping member connected by a cable to a load source.

BACKGROUND OF THE INVENTION

Exercise machines suitable to improve and increase muscular strength are known, which allow a user both to perform complex movements that simulate traditional free body exercises, and also the possibility of extending the type and the load of the exercises.

The machines are generally made up of a resistant load carried to a gripping element by means of a cable, which generally slides around a plurality of pulleys. The resistant load can be "generated" by means of stacks of weights, elastic devices, pneumatic or electronic actuators.

In these types of machines the resistant load, that is, the force that the user perceives in correspondence with the gripping member and which he/she has to contrast in order to perform a specific movement, always acts in the direction of the cable that carries the load to the gripping element. In the same way, if the gripping element involves multiple cables or segments of cable, the direction of the resistant force perceived by the user is given by the vector sum of the forces acting in the direction of each cable or segment.

Since the point of exit of the cable from a frame of the machine is stationary while a determinate exercise is being performed—although it can be manually adjusted before starting the exercise—in these known machines the effective direction of the resistant load depends on the spatial position of the gripping element. This implies that the user can only control the direction of the resistant load by assuming a specific position in space and performing the exercise in a specific manner. For example, if the user wants to maintain a constant direction of the resistant force for any position whatsoever in space, he/she would have to perform the exercise by moving the gripping element in a direction parallel to the cable, that is, manually keep the orientation of the cable constant.

It is evident that it is difficult to keep the direction of the resistant force constant, unlike what occurs in free weight training where the weight force always acts in the same downward direction.

In addition, conventional machines are bulky, having a support frame considerably larger than the actual work area available to the user, and heavy due to structural reasons and safety requirements that have to be met.

In conventional machines, moreover, the user interfaces by means of which users can start or interrupt the performance of an exercise, or change the resistant load, are positioned on the frame of the machine itself and therefore it is not comfortable for a user to interact with them while performing an exercise.

From patent application WO-A-2017/133823 filed in the name of the Proprietors, an exercise machine is also known comprising a rail, a slider installed slidingly on the rail, and provided with a first and a second pulley free to rotate about respective axes of rotation, a gripping element and traction cables comprising a first branch and a second branch, each one partly wound around a pulley, and connected with one free end to the gripping element and with the opposite end to a load source. The solution described in WO-A-2017/133823, while allowing to maintain the direction of the resistant force constant, does not allow to obtain an optimal control of the force at low load levels.

One purpose of the present invention is therefore to provide an exercise machine which overcomes at least some of the disadvantages of the state of the art.

In particular, one purpose of the present invention is to provide an exercise machine able to vectorize the resistant load, giving the user the perception of using free weights (barbells, disc weights, etc.) subjected to the force of gravity, constantly maintaining the resistant load in the direction toward the ground, or allowing other particular effects and types of exercise by varying the direction of the resistant load in a controlled manner.

Another purpose of the invention is to provide the ability to move or hold the exit point of the cable toward a specific position using only the load sources themselves.

Another purpose of the invention is to obtain an exercise machine that is compact and easy to move, and which guarantees high levels of safety during use by users without needing to constrain it to the ground, to walls or to fixed objects.

Another purpose of the invention is to provide an exercise machine that provides a resistant force having defined intensities and directions even at low load levels.

The Applicant has devised, tested and embodied the present invention to overcome the shortcomings of the state of the art and to obtain these and other purposes and advantages.

SUMMARY OF THE INVENTION

The present invention is set forth and characterized in the independent claims. The dependent claims describe other characteristics of the present invention or variants to the main inventive idea.

In accordance with the present invention, a machine for gymnastic exercises comprises:

- a gripping element which can be gripped by a user;
- a first motor and a second motor, able to be commanded independently from each other and each configured to generate respective loads suitable to define a resistant force on the gripping element during a traction exerted on the latter by the user;
- a sliding guide;
- a slider installed slidingly on the sliding guide;
- a pulley installed on the slider and rotatable in an idle manner around an axis of rotation.

According to one aspect of the present invention, the machine comprises cable traction means configured to transfer the loads generated by the motors to the gripping element, and comprising a first cable at least partly wound around the pulley and connected with a first end to the gripping member and with a second opposite end to the first motor, and a second cable provided with a first end attached to the slider and a second end connected to the second motor.

According to another aspect, the machine also comprises a control and command unit connected to the first motor and to the second motor and configured to define the resistant force.

According to some embodiments, the control and command unit is configured to regulate the functioning of the first motor and of the second motor in order to supply a resistant force that has constant intensity and direction in correspondence with the gripping member.

The fact that the gripping element is connected to only one cable allows the user greater freedom of movement, without the risk of being caught in it while performing an exercise.

Furthermore, since the motors are connected to different elements, the system of vectorization of the forces is not symmetrical and, therefore, neither are the frictions, therefore it is possible to obtain a better control of the intensity and direction of the resistant force also at low load levels.

Here and in the following description and claims, with the term "cable" we mean both a cable as such, and also components similar to it, such as belts and chains.

According to some embodiments, the first cable defines a first return segment comprised between the first motor and the pulley and a second return segment comprised between the pulley and the gripping element, and the first return segment extends from one side of the slider substantially parallel to the sliding guide.

According to some embodiments, the second cable also extends substantially parallel to the sliding guide, from the side of the slider opposite the first return segment.

The direction of the resistant force perceived by the user in correspondence with the gripping element can be controlled by the user and is maintained at a constant value without any intervention whatsoever of other actuators in addition to the load sources.

According to some embodiments, there can be provided sensors for the detection of the direction, connected to the control and command unit and configured to detect the direction of the resistant force, and the control and command unit can be configured to perform a feedback control of the load sources as a function of the actual direction detected by these sensors.

According to some embodiments, the load sources comprise respective commandable electric motors.

According to preferred embodiments, the electric motors can be compact electric motors suitable to be installed in confined spaces, allowing to produce a compact exercise machine. The load sources can also comprise other components suitable to make them function in an appropriate manner, including a power source, a motor controller, one or more sensors for detecting the speed of the motor and/or the resistant load actually supplied.

According to some embodiments, the motors are connected to a winding drum on which the cables are wound and unwound as a function of the movement and exercise performed by the user, and the motors are configured to maintain the desired tension on the cable allowing the dynamic control of the intensity of the resistant force.

According to some embodiments, the motors are suitable to act both as load sources and also as detection devices suitable to monitor the user's movements and recognize specific gestures of the user in order to control the functioning of the machine.

This capacity is achieved thanks to the substantial proportionality between the tension applied to the motor and the speed of the motor, or by means of specific sensors (for example encoders) suitable to measure the speed of the motor, which is correlated to the user's movements.

According to some embodiments, the gripping element comprises interface devices by means of which the user can command the functioning of the machine, which are configured to recognize determinate gestures of a user. The combination of load sources comprising electric motors together with the interface devices, make the machine very versatile and easy to be commanded by a user even while performing a determinate exercise.

According to a possible implementation, the exercise machine according to the invention can comprise a platform, on which the user can position him/herself in order to perform an exercise, and inside which all the components are housed, and from which the first cable exits, connected to the gripping element. This configuration allows to increase the safety of the machine, since the user never comes into contact with mobile parts of the machine which could injure him/her.

BRIEF DESCRIPTION OF THE DRAWINGS

These and other characteristics of the present invention will become apparent from the following description of some embodiments, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

Figure 1:
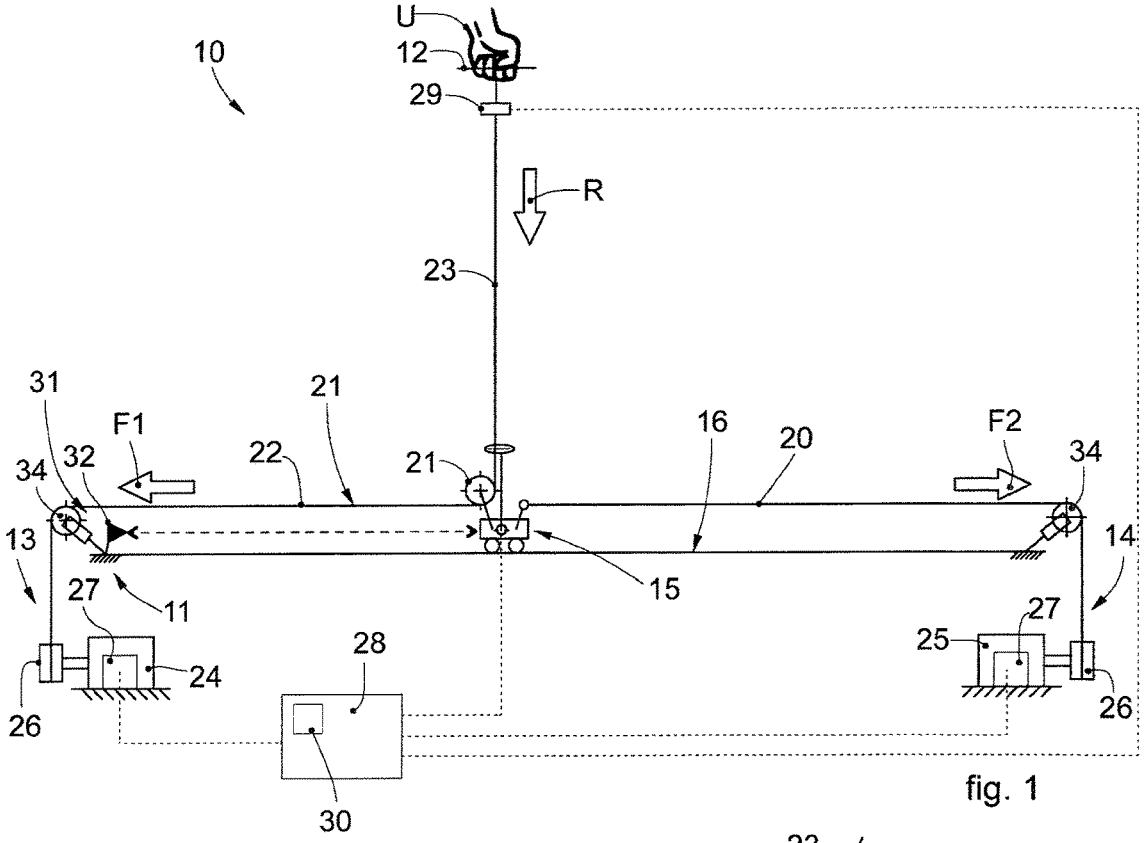
FIG. 1 is a schematic illustration of an exercise machine according to the embodiments described here.

Embodiments described here with reference to the attached drawings concern a machine 10 for gymnastic exercises, suitable to be used to practice a plurality of gymnastic exercises for the purpose of muscle training or rehabilitation.

The machine 10 according to the invention comprises a machine frame 11 configured to support at least part of the components of the machine 10.

According to some embodiments, the machine frame 11 can comprise a support base and possibly connection brackets configured to connect the machine 10 to a wall or floor, or to a frame which in turn can be attached to a wall or floor.

The machine 10 according to the invention comprises a gripping element 12 configured to be gripped and held by a user, and on which, during use, a user U exerts a traction force.

According to some embodiments, the machine 10 comprises a first load source 13 and a second load source 14 configured to generate a resistant force R that acts on the gripping member 12 which is opposed to the traction force exerted by the user.

The first load source 13 and the second load source 14 respectively comprise a first motor 24 and a second motor 25 configured to each generate respective loads F1, F2 suitable to define a resistant force R with constant intensity and direction perceived on the gripping member 12 during a traction exerted on the latter by the user.

In accordance with possible solutions, the motors 24, 25 can comprise a rotary motor or a linear motor.

According to some embodiments, the machine 10 also comprises at least one slider 15 installed slidingly, that is, free to slide, on a sliding guide 16.

According to some embodiments, the sliding guide 16 can be made in the support frame 11, or be coupled to it.

According to some embodiments, the sliding guide 16 can be rectilinear, or have a circular arc, or circular, conformation.

The sliding guide 16 can be defined by an internally hollow section bar suitably shaped to receive the slider 15 inside it in a sliding manner.

By way of example only, the section bar can be C-shaped, inside which the slider 15 is located.

Figure 2:
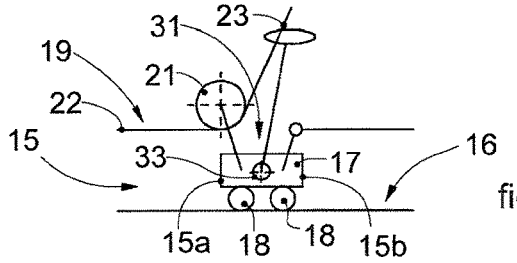
FIG. 2 is an enlarged detail of FIG. 1.

According to some embodiments, for example described with reference to FIG. 2, the slider 15 can comprise a support body 17 and sliding elements 18, for example one or more wheels, spheres, or bearings, suitable to facilitate the sliding of the slider 15 along the support guide 16.

The machine 10 according to the invention also comprises cable traction means configured to transfer the loads generated by the first motor 24 and by the second motor 25 in correspondence with the gripping element 12.

The cable traction means comprise a first cable 19 connected with a first end to the gripping element 12 and with a second end to the first motor 24, and a second cable 20 connected at a first end in a fixed manner to the slider 15 and at the second end to the second motor 25.

According to some embodiments, the first cable 19, with its first end, is connected only to the gripping element 12.

According to some embodiments, the second cable 20, with its first end, is connected only to the slider 15.

According to some embodiments, the machine 10 comprises a pulley 21 installed on the slider 15 and configured to rotate in an idle manner about an axis of rotation.

The pulley 21 is preferably installed on the slider 15 on the side facing toward the first load source 13, during use.

The first cable 19 is at least partly wound around the pulley 21 so as to define a first return segment 22 comprised between the pulley 21 and the first motor 24, and a second return segment 23 comprised between the gripping element 12 and the pulley 21.

According to some embodiments, the first return segment 22 extends from a first side 15*a* of the slider 15 substantially parallel to the sliding guide 13, and the second return segment 23 extends angled with respect to the first return segment 22 as a function of the position of the user.

According to some embodiments, the second cable 20 extends from a second side 15*b* of the slider 15 opposite the first side, substantially parallel to the sliding guide 13.

The first motor 24 connected to the gripping element 12 is configured to contrast the traction force generated by the user, while the second motor 25 connected to the slider 15 is configured to contrast the sliding thereof caused by the traction action of the user.

Thanks to the particular configuration of the slider 15 and of the first cable 19 and second cable 20, as soon as a user U induces a stress on the gripping element 12, that is, a variation of its position in space, a translation of the slider 15 is determined along the sliding guide 16.

The possibility of translation of the slider 15 along the sliding guide 16 ensures that the user always perceives a same orientation of a resistant force R which is generated as a resultant of the sum of the first load F1 exerted by the first motor 24 and the second load F2 exerted by the second motor 25.

The first motor 24 and the second motor 25 can be commanded electronically and are independent of each other.

According to some embodiments, the first motor 24 and the second motor 25 are electric motors, for example pancake motors.

By way of example only, the first motor 24 and the second motor 25 in particular are configured to receive a command to control the intensity and direction of the load, that is, of the resistant force R, in correspondence with the gripping element 12.

By way of example only, it can be provided that the first motor 24 and the second motor 25 are each provided with a drum 26 selectively rotatable about its own axis of rotation, and on which the first cable 19 or respectively the second cable 20 is wound.

According to a possible solution, the machine 10 can comprise return elements 34, for example associated with the machine frame 11 in correspondence with the ends of the sliding guide 16, and configured to maintain respectively the first return segment 22 of the first cable 19 and the second cable 20 substantially parallel to the longitudinal development of the sliding guide 16.

According to some embodiments, the first motor 24 and the second motor 25 are provided with respective control devices 27 provided to control the stress that the first motor 24 and the second motor 25 are able to oppose against the movement of the first cable 19 and of the second cable 20.

According to possible solutions, the control devices 27 can be configured to detect respectively the first load F1 and the second load F2 exerted on the first cable 19 and on the second cable 20.

By way of example only, the control devices 27 can comprise a force sensor, a load cell, an extensometer, or similar or comparable sensors.

According to possible variants, the control devices 27 can be configured to detect at least one electrical functioning parameter of the first motor 24 and of the second motor 25, such as for example the electric current absorbed.

The machine 10 can also comprise a control and command unit 28 configured to coordinate the drive of the first motor 24 and of second motor 25, and to determine the magnitude of the first load F1 and of the second load F2 imparted on the first cable 19 and on the second cable 20.

In particular, by suitably coordinating the magnitude of the loads F1, F2 it is possible to determine a predefined angle of the second return segment 23 of the first cable 19 in order to make the user U perceive a predefined angle of the resistant force R.

Figure 3:
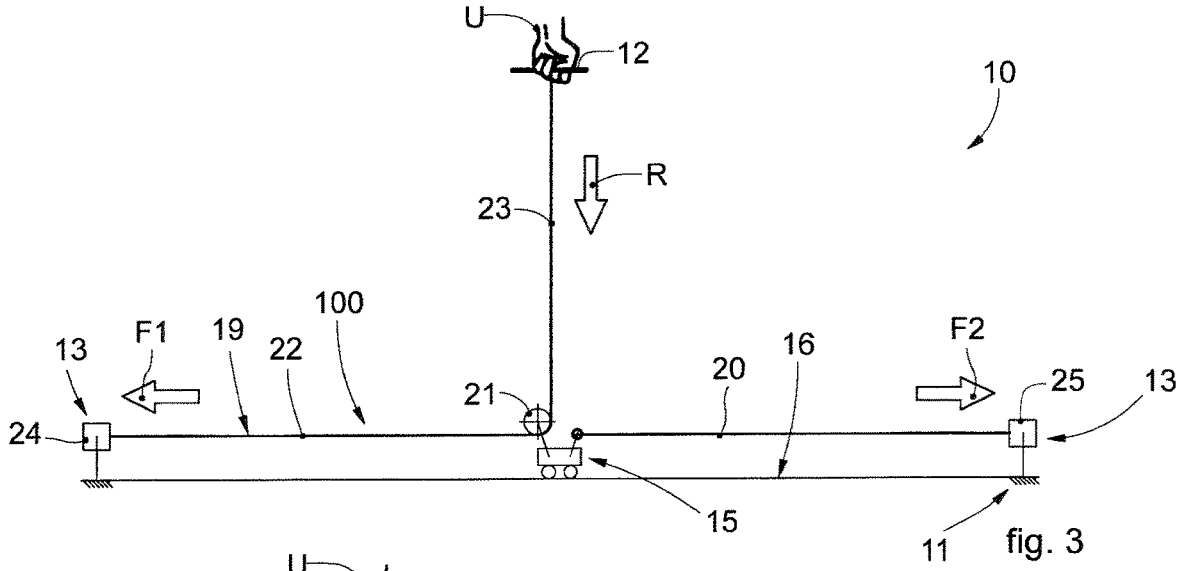
FIG. 3 is an illustration of the machine of FIG. 1 in a condition of use.

FIG. 3 shows a position in which the slider 15 is disposed below the gripping element 12, for example while a user is exerting a traction force in the vertical direction. In this condition, the resistant force R is given by the sum of the first load F1 and the second load F2 and is directed in the vertical direction downward, substantially orthogonal to the sliding guide 16.

Figure 4:
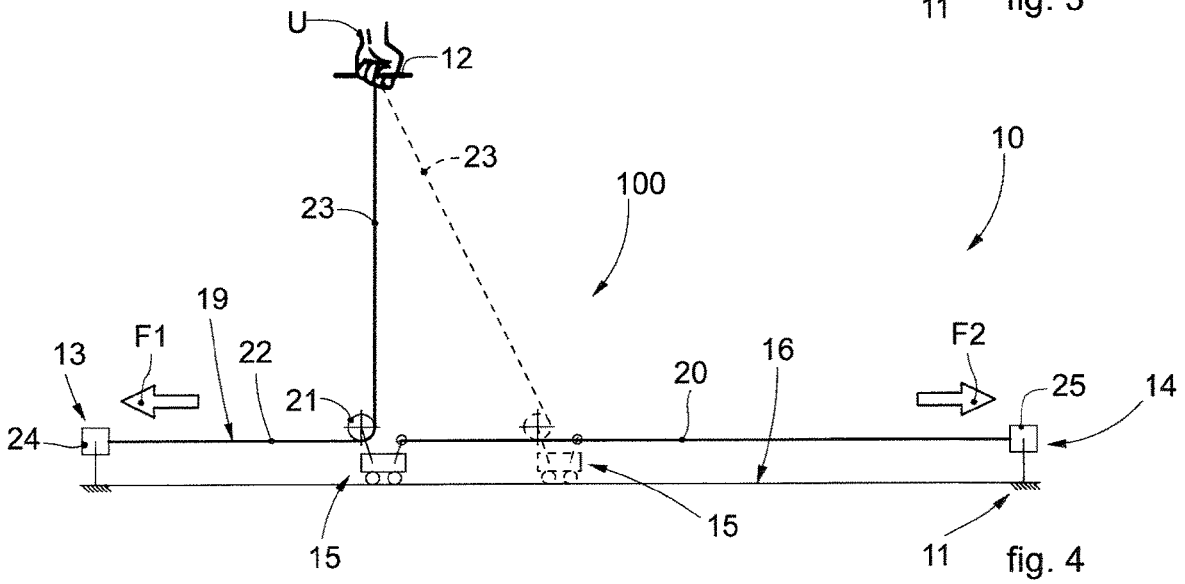
FIG. 4 is an illustration of the machine of FIG. 1 in a different condition of use.

The dashed lines in FIG. 4 show a position in which the user U is pulling the gripping element 12 in an inclined direction with respect to the position of FIG. 3.

In this case, the control and command unit 28 regulates the functioning of the first motor 24 and of the second motor 25 in order to modify the loads F1, F2 imparted on the first cable 19 and on the second cable 20 so that the slider 15 is again positioned below the gripping element 12, as shown with a solid line, so as to follow the position and movements of the user U.

The drive of the motors 24, 25 entails the adjustment of the respective lengths of the first cable 19 and of the second cable 20, winding or unwinding them onto/from the respective drum 26.

Figure 5:
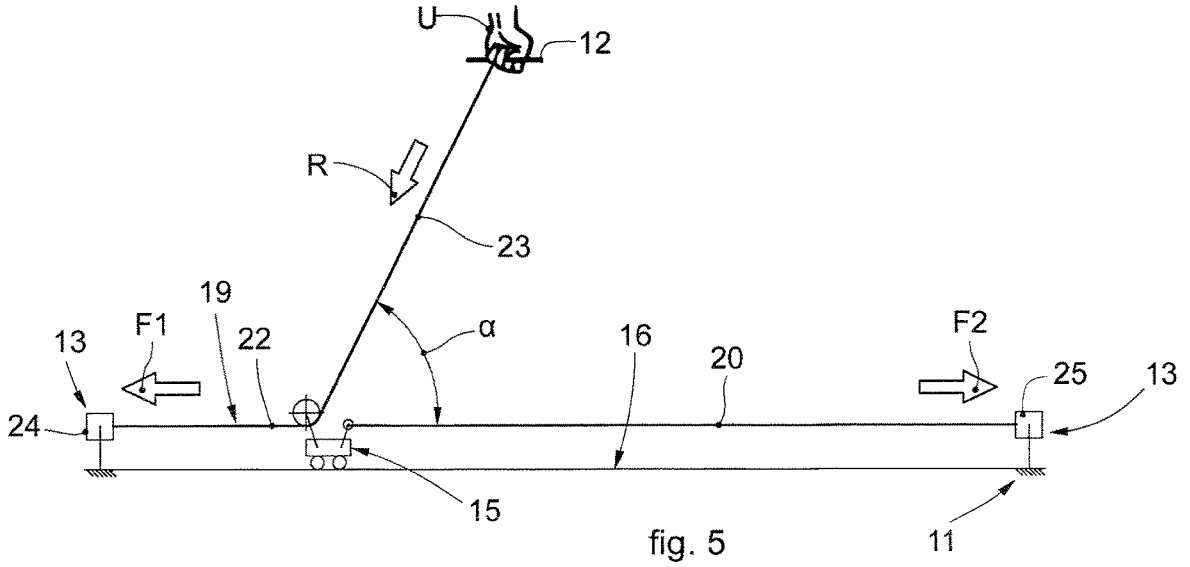
FIG. 5 is an illustration of the machine of FIG. 1 in another condition of use.

FIG. 5 shows a different operative position of the machine 10, in which the second return segment 23 is inclined by an angle $\alpha$ with respect to the direction of the first return segment 22 and to the sliding guide 16.

The angle $\alpha$ only depends on the forces F1, F2, which can be modulated in order to obtain the desired behavior. In this condition, the user U can freely move the gripping element 12 perceiving a resistant force R equal to F1+F2 oriented at an angle $\alpha$ with respect to the horizontal.

The controls performed by the control and command unit 28 can be performed during the use of the exercise machine 10.

To adjust the intensity and angle of the resistant force R, the control and command unit 28 can be configured to perform different control modes, for example:

control the resistant force R and its angle of perception of force;

control the resistant force R and the position of the slider 15.

According to some embodiments, the machine 10 can comprise an interface device 29 connected to the control and command unit 28, by means of which a user U can interact in order to command specific modes of performing the exercises.

The commands provided by the interface device 29 are used to determine the drive mode of the first motor 24 and the second motor 25.

In particular, it can be provided that the control and command unit 28 is provided with storage devices 30 in which predefined functioning programs of the machine 10 are stored. By means of the interface device 29, the user U can select one or the other of the functioning programs, determining different drive modes of the first motor 24 and the second motor 25.

In accordance with possible formulations of the present invention, with the first cable 19 and with the second cable 20 there can be associated detectors, in this specific case the control devices 27, configured to detect determinate stresses and/or movements exerted by the user U on the gripping element 12.

The control and command unit 28 is configured to receive from the control devices 27 data relating to the respective load stresses, to process the data received, and possibly identify particular gestures performed by the user U.

The control and command unit 28 can also be configured to compare these gestures detected with predefined movement patterns which are stored, for example, in the storage devices 30.

With each predefined movement pattern there can be associated a specific functioning command of the machine, that is, suitable for the performance of a specific exercise, for the increase of the intensity of the resistant force R, for the variation of the angle of the resistant force R, or other.

By way of example only, the interface device 29 can be provided with a button, a screen, a touch-sensitive screen, by means of which the user U can define, for example, the intensity and direction of the resistant force R on the element gripping, and therefore the loads exerted by the first motor 24 and by the second motor 25.

According to some embodiments, the interface device 29 can be associated with the gripping member 12, in order to facilitate its use by the user U even during the performance of the exercises.

In accordance with possible solutions, a motion sensor, not shown, configured to detect the movements of the gripping member 12 imparted by the user U, can be associated with the gripping element 12

By way of example only, it can be provided that this motion sensor is used to detect the gestures and command the functioning of the machine 10 in a manner substantially similar to that described above with reference to the control devices 27.

Again in accordance with possible variants, not shown, the control and command unit 28 can be provided with information transmission devices, configured to transmit, for example remotely, by means of suitable communication protocols, to a remote device such as smartphones, a smart TVs, game consoles, virtual reality headsets, or other, for example data detected during the use of the machine 10. The detected data can be interpreted and combined by an app installed on the remote device, with the possibility of sharing them with other users.

In accordance with another solution, the exercise machine 10 can be provided with detection devices 31 configured to detect at least one of either the position of the slider 15 along the sliding guide 16, or the angle of the second return segment 23 with respect to the first return segment 22.

According to a possible solution, the detection devices 31 can comprise at least a first sensor 32 associated with the machine frame 11, for example with the sliding guide 16 and/or with the slider 15. The first sensor 32 is configured to detect the position of the slider 15 along the sliding guide 16.

According to another solution, the detection devices 31 comprise a second sensor 33 configured to detect the angle of the second return segment 23 with respect to the first return segment 22. By way of example only, the second sensor 33 can be installed on the slider 15.

The first sensor 32 and/or the second sensor 33 can comprise at least one of either a photocell, a laser sensor, an inductive sensor, or a capacitive sensor.

The control and command unit 28, by detecting at least one of either the positioning data of the slider 15, or the angle of the second return segment 23, is able to instantly define the drive modes of the first motor 24 and of the second motor 25, and therefore determine the intensity and direction of the resistant force R acting on the gripping element 12 and perceived by the user U.

According to possible solutions, the control and command unit 28 is configured to control the torques delivered by the first motor 24 and the second motor 25 and keep them constant, or variable over time according to a predefined profile.

The rotation speed of the motors, on the other hand, can be free and depend on the movements of the user U.

According to further embodiments, if a plurality of detection devices 31 are present, it can also be provided that the torque and speed of the first motor 24 and second motor 25 are controlled by means of feedback signals.

According to a possible solution, the sliding guide 16, the slider 15, the first pulley 21, the gripping element 12, the first load source 13 and the second load source 14, together with the first cable 19 and the second cable 20, can collectively define an exercise module 100.

According to possible solutions, a single exercise module 100 can itself define the exercise machine 10.

Figure 6:
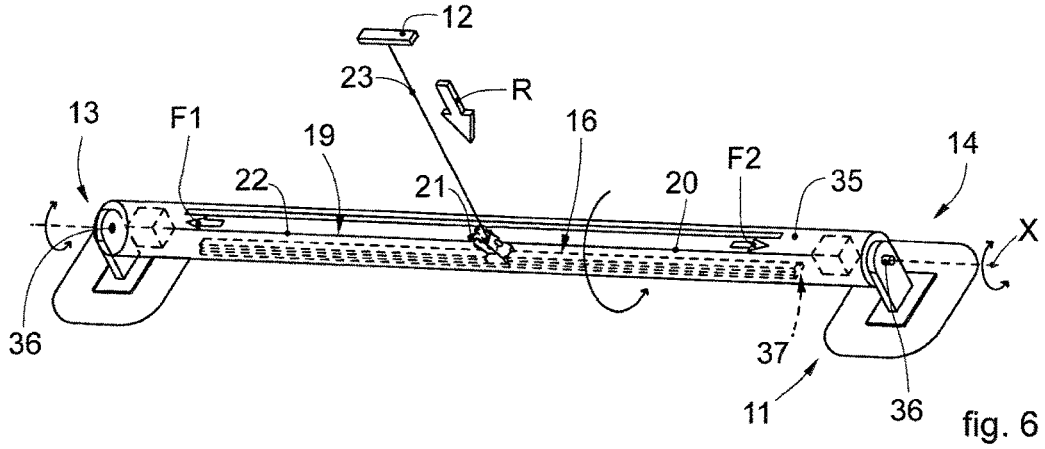
FIG. 6 shows a possible solution of the schematic illustration in FIG. 3.
Figure 7:
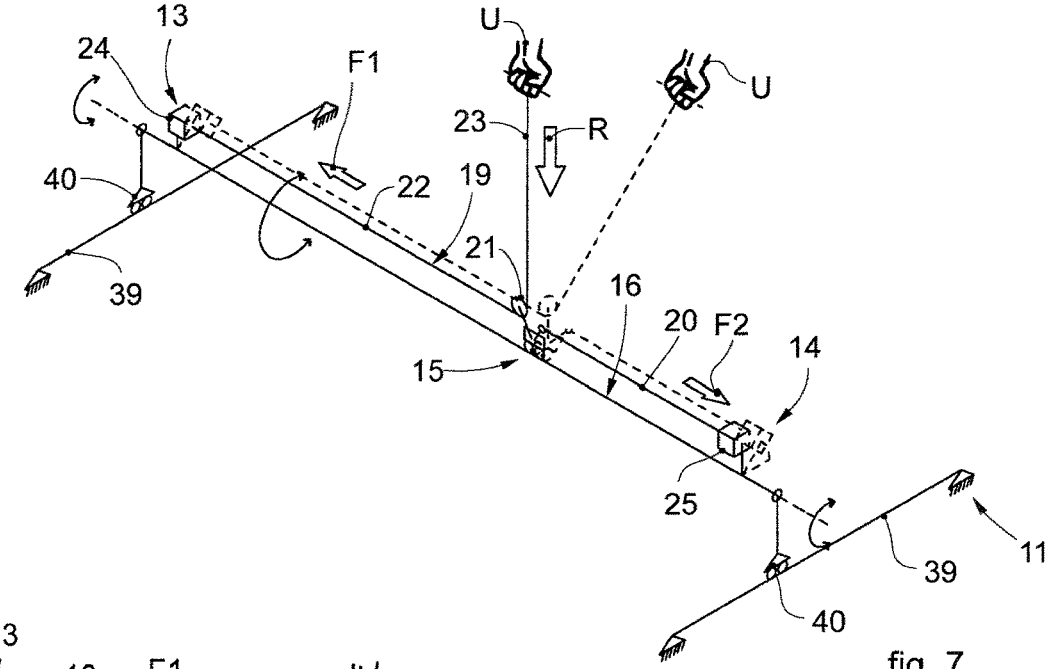
FIGS. 7 and 8 show possible variant embodiments of FIG. 2.
Figure 8:
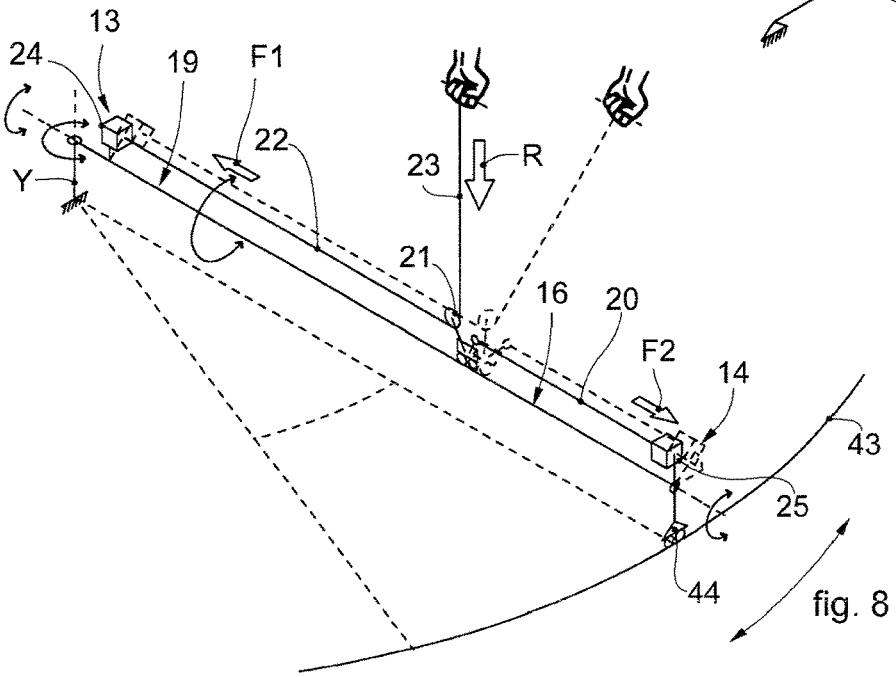

FIGS. 6-8 show solutions relating to an exercise module 100 as described above.

In accordance with the solution shown in FIG. 6, it is provided that the sliding guide 16 is installed so that it can rotate, with respect to the machine frame 11, about an axis of rotation X parallel to the longitudinal extension of the sliding guide 16 itself.

This configuration allows to provide greater versatility of use to the exercise machine 10.

In accordance with this variant, the first load source 12 and the second load source 13 can be moved in rotation integrally with the rotation of the sliding guide 16.

According to the embodiment shown in FIG. 6, moreover, it can be provided that the sliding guide 16 is installed on a support element 35.

The support element 35 can be supported at its two ends by pivoting elements 36 attached to a fixed structure. The pivoting elements 36 are configured to allow a rotation of the support element 35 about the axis of rotation X.

According to a possible variant, the pivoting elements 36 can themselves define the machine frame 11, or they can be an integral part thereof.

In accordance with the solution of FIG. 6, the support element 35 can have a box-like or tubular shape, that is, it is provided with at least one cavity 37 in which the sliding guide 16 is attached, and in which the slider 15 is at least partly contained.

The support element 35 can comprise a slit 38 that connects the cavity 37 with the outside, and which extends substantially parallel to the sliding guide 16, through which at least the second return segment 23 of the first cable 19 passes.

The first load source 13 and the second load source 14 provided with the respective first motor 24 and second motor 25 can be installed integrally on the support element 35, in this specific case in the cavity 17 of the latter.

In accordance with another embodiment, for example shown in FIG. 7, it can be provided that the sliding guide 16 is installed on transverse guides 39 positioned transverse, in this specific case orthogonal, to the longitudinal development of the sliding guide 16.

According to this embodiment, the machine frame 11 comprises the transverse guides 39 installed either on a fixed structure or on other parts of the machine frame 11.

The sliding guide 16 is associated directly, or indirectly, for example by means of the support element 35, with sliding devices 40 installed sliding along the transverse guides 39. The sliding devices 40 can comprise a slider and wheels and/or spheres, or bearings, for the guided sliding of the slider along the transverse guides 39.

Also in this embodiment, it is possible to provide that the sliding guide 16 is rotatable about the axis of rotation X.

According to another variant, described for example with reference to FIG. 8, it is possible to provide that the sliding guide 16 is selectively or freely rotatable about a second axis of rotation Y, orthogonal to the longitudinal development of the sliding guide 16.

In accordance with a possible solution, shown in FIG. 8, the second axis of rotation Y is positioned in correspondence with a first end 41 of the sliding guide 16.

A second end 42 of the sliding guide 16, opposite the first end 41, is free to slide along a circular arc-shaped trajectory 43. In accordance with this solution, the second end 42 can be provided with sliding devices 44 configured to support and allow the sliding of the sliding guide 16 with respect to a support plane.

In accordance with possible solutions, with the circular arc-shaped trajectory 43 there can be associated a curved guide, not shown, provided to control and guide the movement of the second end 42. The curved guide can be associated with the machine frame 11.

In accordance with possible solutions, described with reference to FIG. 8, as well as being rotatable about the second axis of rotation Y, the sliding guide 16 can also be rotatable about the axis of rotation X in a manner substantially similar to that described with reference to FIGS. 6 and 7.

Figure 9:
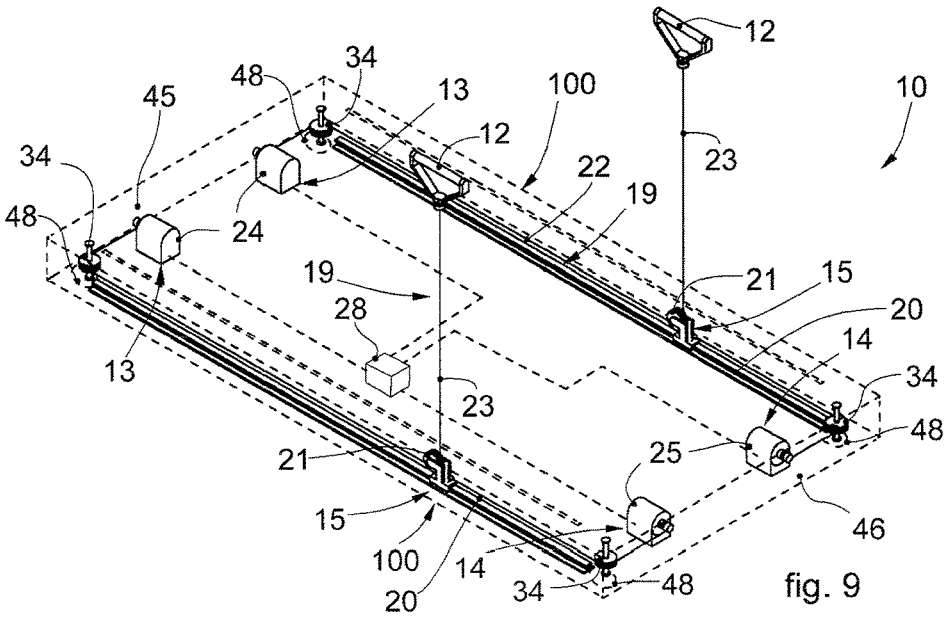
FIG. 9 shows another embodiment of the present invention.

In accordance with the solution shown in FIG. 9, the exercise machine 10 comprises two exercise modules 100 installed in a single machine frame 11.

In the event the exercise machine 10 comprises two or more exercise modules 100, a single control and command unit 28 can be provided to control the motors of all the exercise modules 100.

The machine frame 11 can comprise a footboard 45 defined by a box-like body 46 in which at least the first motors 24 and the second motors 25 are housed.

According to some embodiments, the machine 10 comprises a safety device 47 configured to ensure the stability of the machine 10, even in dynamic conditions, that is, during its use by the user U or in any case if someone accidentally descends from it holding a loaded gripping element 12.

The safety device 47 can be used on one or the other of the embodiments described here and in any other machine for muscle training.

The safety device comprises a number of force sensors 48 installed below the machine frame 11 and configured to completely support the machine 10 resting on a plane.

The force sensors 48 can be installed in the footboard 45 on the side facing the support plane and are configured to detect the weight of the user U acting on the footboard 45. The machine 10 also comprises an alarm device connected to the sensors 48 and configured to process the weight data detected, and to provide an alarm signal if at least one of the data detected is lower than a determinate threshold.

When at least one sensor detects a weight tending to zero, indicative of the fact that the machine frame 11 is losing contact with the support plane and therefore an unstable condition of the machine 10 and possible overturning may occur, an alarm is generated to warn the user U of the potential hazard. This characteristic renders the use of a large support base or a heavy frame, or the attachment of the machine 10 to a wall or floor, unnecessary.

It is clear that modifications and/or additions of parts may be made to the exercise machine 10 as described heretofore, without departing from the field and scope of the present invention.

It is also clear that, although the present invention has been described with reference to some specific examples, a person of skill in the art shall certainly be able to achieve many other equivalent forms of exercise machine 10, having the characteristics as set forth in the claims and hence all coming within the field of protection defined thereby.

The invention claimed is:

1. An exercise machine for gymnastic exercises comprising:

a gripping element (12) which can be gripped by a user;

a first motor (24) and a second motor (25), able to be commanded independently from each other and each configured to generate respective loads (F1, F2) suitable to define a resistant force (R) perceived on the gripping element (12) during a traction exerted on the latter by the user;

a sliding guide (16);

a slider (15) installed slidingly on the sliding guide (16);

a pulley (21) installed on the slider (15) and rotatable in an idle manner around an axis of rotation, wherein it comprises:

cable traction means configured to transfer the loads (F1, F2) generated by the motors (24, 25) to the gripping element (12), said cable traction means comprising a first cable (19) at least partly wound around the pulley (21), and connected with a first end to the gripping member (12) and with a second end to the first motor (24), and a second cable (20) provided with a first end attached to the slider (15) and a second end connected to the second motor (24), and a control and command unit (28) connected to the first motor (24) and to the second motor (25) and configured to define said resistant force (R).

2. The exercise machine as in claim 1, wherein said first cable (19) defines a first return segment (22) comprised between said first motor (24) and said pulley (21) and a second return segment (23) comprised between said pulley (21) and said gripping element (12), wherein said first return segment (22) extends from one side of said slider (15) substantially parallel to the sliding guide (16).

3. The exercise machine as in claim 1, wherein said second cable (22) extends from one side of said slider (15) substantially parallel to the sliding guide (16).

4. The exercise machine as in claim 1, wherein the first motor (24) and the second motor (25) are provided with respective control devices (27) configured to control the loads (F1, F2) that the first motor (24) and the second motor (25) are able to oppose in counter position to the movement of the first cable (19) and of the second cable (20).

5. The exercise machine as in claim 1, wherein it comprises an interface device (29) connected to said control and command unit (28) and with which the user (U) interacts to command specific modes to perform the exercises, said commands provided by said interface device (29) being configured to determine the drive mode of the first motor (24) and the second motor (25).

6. The exercise machine as in claim 1, wherein said interface device (29) is associated with said gripping element (12).

7. The exercise machine as in claim 1, wherein said control and command unit (28) is configured to receive, from detection devices, data relating to the respective stresses acting on the first cable (19) and on the second cable (20), in order to process said data, to identify gestures made by the user (U) and to compare said gestures with predefined and memorized movement patterns, a specific functioning command of the machine being associated with each predefined pattern.

8. The exercise machine as in claim 2, wherein it comprises detection devices (31) configured to detect at least one of either the position of the slider (15) along the sliding guide (16) or the angle of the second return segment (23) with respect to the first return segment (22).

9. The exercise machine as in claim 1, wherein said sliding guide (16) is installed, with respect to a machine frame (11), rotatable around an axis of rotation (X) parallel to the longitudinal extension of the sliding guide (16).

10. The exercise machine as in claim 1, wherein it comprises a machine frame (11) provided with a footboard (45) comprising a box-like body (46) inside which at least the first motor (24) and the second motor (25) are installed, and configured to support the weight of a user (U), wherein sensors (48) are associated with said footboard (45) and are configured to detect the weight of the user (U) on said footboard (45) and an alarm device configured to process the weight data detected by said sensors (48) and to provide an alarm signal if at least one of said data detected is less than a predetermined threshold.

* * * * *